United States Patent [19]

Cozzie

[11] Patent Number: 4,607,242

[45] Date of Patent: Aug. 19, 1986

[54] MICROWAVE FILTER

[75] Inventor: James C. Cozzie, Solon, Iowa

[73] Assignee: Rockwell International Corporation, El Segundo, Calif.

[21] Appl. No.: 490,282

[22] Filed: May 2, 1983

[51] Int. Cl.[4] ..... H01P 1/207; H01P 11/00

[52] U.S. Cl. ..... 333/209; 333/208; 333/248; 29/600

[58] Field of Search ..... 333/202–203, 333/206–212, 219–225, 235, 245, 248; 29/600

[56] References Cited

U.S. PATENT DOCUMENTS

| | | | |
|---|---|---|---|
| 3,505,618 | 4/1970 | McKee | 333/209 X |
| 3,593,221 | 7/1971 | Reed | 333/208 |
| 3,657,670 | 4/1972 | Kitazume et al. | 333/209 |
| 4,410,868 | 10/1983 | Meguro et al. | 333/212 |
| 4,425,555 | 1/1984 | Meguro et al. | 333/202 |
| 4,431,977 | 2/1984 | Sokola et al. | 333/206 |

FOREIGN PATENT DOCUMENTS

| | | | |
|---|---|---|---|
| 0001301 | 1/1983 | Japan | 333/254 |
| 1199908 | 7/1970 | United Kingdom | 333/202 |

OTHER PUBLICATIONS

Southworth—"Principles and Applications of Waveguide Transmission", D. Van Nostrand Co., Princeton, N.J., Feb. 1959; pp. 97–102, and Title page.

"Generation and Transmission of Microwave Energy" TM 11-673, Dept. of the Army, Jun. 1953; pp. 39–51, 75, and Title Page.

*Primary Examiner*—Marvin L. Nussbaum

*Attorney, Agent, or Firm*—George A. Montanye; H. Fredrick Hamann

[57] ABSTRACT

A low-loss bandpass microwave filter is disclosed which enables filter size reduction in the frequency range of 1–5 GHz. The filter includes a main ceramic body member which is notched or drilled and coated over all exposed surfaces except for opposite end portions. Coupling terminals are attached to the opposite end portions to provide microwave input and output coupling to the filter.

5 Claims, 6 Drawing Figures

MICROWAVE FILTER

BACKGROUND OF THE INVENTION

The present invention relates to electrical filters and, more particularly, to bandpass waveguide filters for use at microwave frequencies.

The use of microwave filters is well known in the prior art and includes filters operable in the gigahertz frequency ranges for both bandpass and bandstop filter applications. Waveguide filters have been successfully used at the upper ranges of the GHz frequencies and other filter configurations, including dielectric resonators, have been employed for use at various frequencies. Examples of such filters and their characteristics are discussed in the article entitled "Application of Dielectric Resonators in Microwave Components" by Plourde and Chung-Li Ren in *IEEE Transactions on Microwave Theory and Techniques,* Volume MTT-29, No. 8, Aug. 1981, pp. 754–770, and in the book entitled Microwave Filters, *Impedance-matching Networks, and Coupling Structures* by Matthew, Young and Jones, McGraw Hill, 1964, pp. 450–459.

The above articles discuss the types of filter structures that may be constructed using dielectric materials and disclose techniques for controlling tuning and operation in any given frequency range. As is apparent, use of such dielectric materials acting as resonators for forming microwave filters, requires the selection of materials having parameters which fall within certain limits. More specifically, the quality factor Q should typically be selected to be approximately 10,000 or greater; the dielectric constant ($\epsilon$) should be selected to have a value greater than 35; and the temperature coefficient of resonant frequency $\underline{T}_f$ should be chosen to be less than 10 ppm/° C. Even when constructed in accordance with the techniques disclosed in the above articles, however there are still limitations which restrict the use of such filters in particular applications.

By way of example, for a dielectric material such as titanium dioxide (rutile phase) which has a Q of 10,000 at 4 GHz and an $\epsilon$ of 100, the value for $\underline{T}_f$ is 400 ppm/° C. which is too high to be useful for practical applications. As explained in the article, for an ambient temperature change of 50° C., the filter frequency of a 4 GHz titanium dioxide resonantor will shift by 80 MHz, which is unacceptable since the bandwidth required for many filters is less than that change. While different materials having less acceptable values for Q and $\epsilon$ may be used in order to obtain a better value of $\underline{T}_f$; the prior art filter configurations have not been capable of providing versatile filters in the 1–5 GHz frequency range which are simple and reliable in operation.

While waveguide filters capable of achieving acceptable results are known in the art, the size of the structure is usually so large at the 1–5 GHz range that it is unacceptable for most applications. For example, an air waveguide filter structure for use at 1–5 GHz would most likely have a length of about 2–6 feet in most applications. In current sophisticated electronic and avionics systems, such size and weight restrictions are unacceptable and prohibit effective use of such filters. There is therefore a need for more simplified structures which can be produced at less cost and are more versatile in operation.

Accordingly, the present invention has been developed to overcome the shortcomings of the above known and similar techniques and to provide a low frequency microwave bandpass filter useful in the 1–5 GHz range.

SUMMARY OF THE INVENTION

In accordance with the present invention, a main body of dielectric material is appropriately notched or drilled and coated with an electrically conductive coating to produce the equivalent of a waveguide filter. In one embodiment, electrical terminals are attached to either end of the main body member in an area devoid of the electrically conductive coating to provide input and output couplings for the microwave energy. In one example, notches are made on the external surface of the main body member forming a structure equivalent to irises while in a second example holes are drilled through the main body member forming structures equivalent to posts in normal waveguide filters. The characteristics of the filter are fixed by the depth of the notches or the diameter of the holes to produce a waveguide bandpass filter of significantly reduced size and fixed frequency filtering characteristics, which do not vary substantially for changes in temperature or frequency over the applicable ranges.

It is therefore a feature of the invention to provide a simple and inexpensive waveguide filter for microwave systems.

It is still another feature of the invention to provide a ceramic filled waveguide filter of reduced size and weight for use in microwave systems.

Yet another feature of the invention is to provide a ceramic waveguide filter of simplified construction for use in the low frequency microwave region of approximately 1–5 GHz.

Still another feature of the invention is to provide a ceramicfilled microwave filter which is relatively stable with respect to temperature to produce a fixed frequency bandpass microwave filter.

These and other advantanges and novel features of the invention will become apparent from the following detailed description when considered with the accompanyin drawings wherein:

DETAILED DESCRIPTION OF A PREFERRED EMBODIMENT

Figure 2:
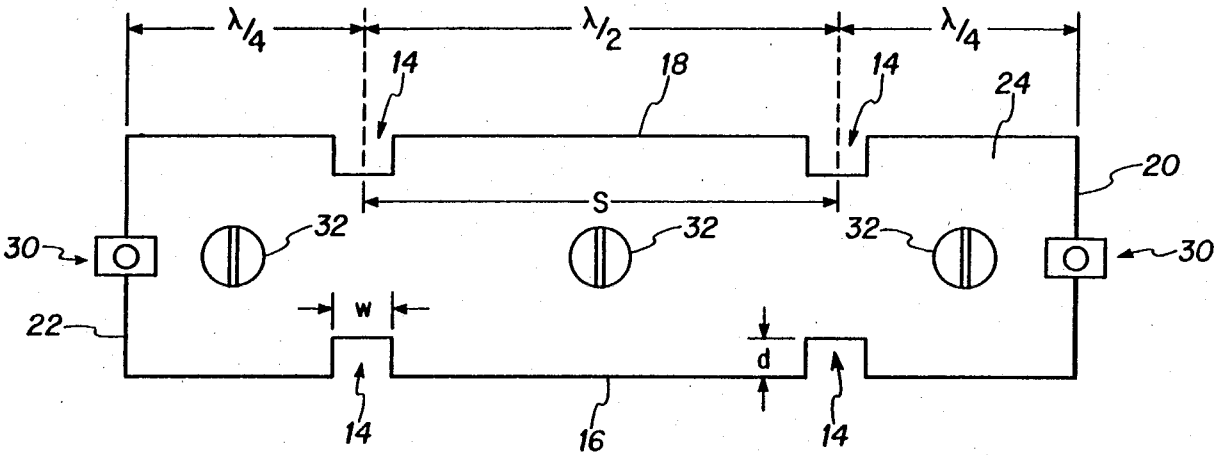
FIG. 2 is a top view of the waveguide filter shown in FIG. 1.
Figure 1:
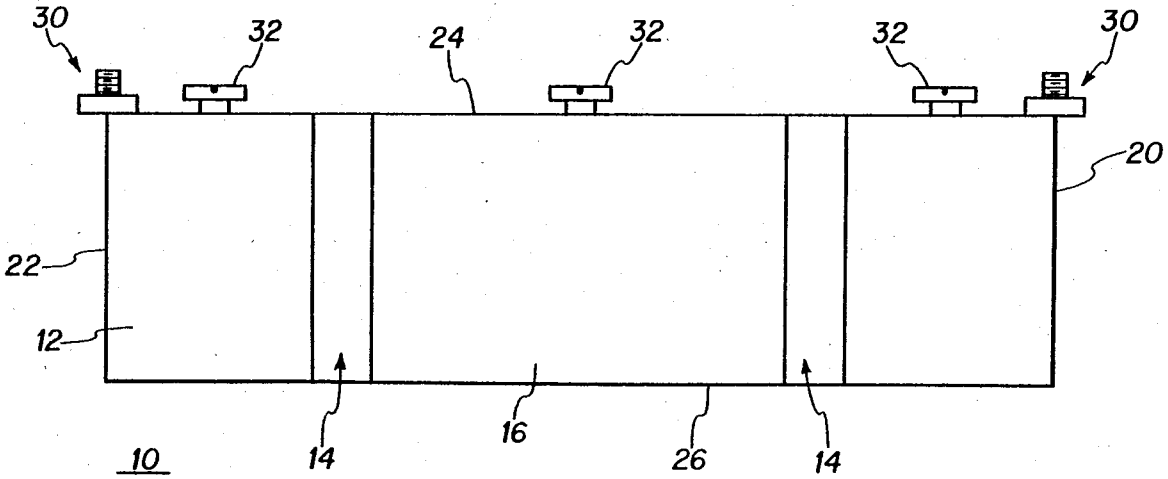
FIG. 1 is a side view of the waveguide filter of the present invention.
Figure 3:
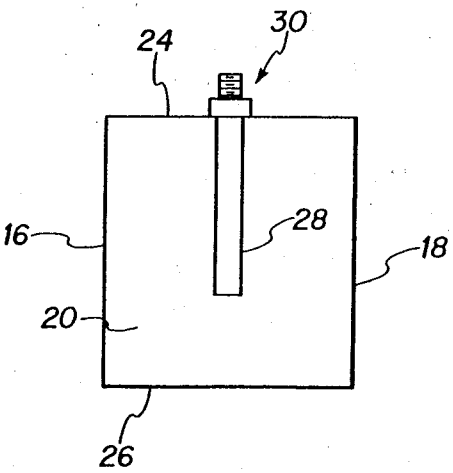
FIG. 3 is an end view of the waveguide filter shown in FIG. 1 showing a voltage coupling input.

Referring now to the drawings, wherein like numerals are used to identify like elements throughout, there is shown in FIG. 1 one embodiment of a microwave bandpass waveguide filter 10 constructed in accordance with the present invention. In the embodiment shown, the filter 10 includes a solid homogeneous ceramic bar 12 forming the main body and having a generally rectangular configuration as can be seen by corresponding FIGS. 2 and 3, respectively. The ceramic bar may be formed from barium tetratitonate, or any other material having suitable characteristics for operation in the intended environment. In selecting such materials, it should be recognized that the materials should have characteristics such that Q is approximately equal to or greater than 10,000, the dielectric constant $\epsilon$ is approximately equal to or greater than 37, and the temperature coefficient of resonant frequency $T_f$ is substantially equal to or less than 10 ppm/° C. While the previous values are representative of those desirable, other values could be used with success, recognizing that certain degradation in filter operation may occur in accordance with the teachings of the prior art.

The ceramic bar 12 is constructed to have a plurality of apertures in the form of vertical notches 14 positioned in pairs on opposed parallel surfaces 16 and 18, respectively, forming the sides of the rectangular bar 12. The notches 14 extend over the height of the bar 12 between the opposed parallel surfaces 24 and 26. In the present example, the notches 14 are formed as U-shaped channels of identical configuration having a uniform depth d and width w, but could obviously have other shapes or forms capable of accomplishing the frequency tuning as will be subsequently described. The number of notches 14 per side may vary from the two shown to form filters having any number of poles. In the present instance, the notches 14 are spaced by a distance of approximately $\frac{1}{4}$ wavelength ($\lambda/4$) from each of the parallel opposed end surfaces 20 and 22, respectively, and are spaced from one another by a distance s of approximately $\frac{1}{2}$ wavelength ($\lambda/2$), to thereby form a one-pole filter in accordance with known waveguide techniques. The notches 14 extend substantially parallel to one another on each side of the bar 12 and are in aligned, opposed parallel relationship to the corresponding notch on the opposite side of the bar 12 to form a notched pair. For a filter operating at a frequency of approximately 1 GHz, the dimensions of bar 12 would be such that the distance from the end 20 to the first notch 14 would be approximately 0.5 inch, the distance s between adjacent notches 14 approximately 1 inch, and the distance from the second notch 14 to the surface 22 at an opposite end approximately 0.5 inch.

Subsequent to the formation of the notched ceramic bar 12, the ceramic is coated with an electrically conductive material over all exposed surfaces of the bar 12, including surfaces 16, 18, 24 and 26, and those surfaces forming the notches 14. The ends of the bar 20 and 22 are left uncoated, as exposed ceramic material. The material used to provide the coating may be any good electrically conductive material, including copper, silver, gold, or similar substance. The conductive coating, which is not specifically shown in the drawings, may typically be of a thickness of about 15–20 mils or greater, and may be applied to the ceramic in any manner capable of bonding the conductive coating to the ceramic material. Such techniques are well known in the prior art, and are not required to be described herein in order for an understanding of the present invention.

At each of the opposed parallel end surfaces 20 and 22, a microwave coupling is provided to enable input and output coupling of microwave energy to the waveguide filter 10. The coupling terminals may be formed by a conductive strip 28, shown in the end view of FIG. 3, which is applied vertically over the face of the uncoated end surface 20. The strip 28 may be formed of a similar electrically conductive coating as that applied to the other surface areas of the bar 12 and is coupled electrically at one end to the center conductor of a conventional coaxial connector 30 having its outer conductor coupled to the electrically conductive coating on surface 24 of the bar 12. An identical conductive strip 28 and coaxial connector 30 is also provided across the end surface 22 of the bar 12. As will be appreciated, the thickness of the strips 28 may also be approximately 15–20 mils or greater and have a width which may typically be 0.1 inch or otherwise to enable the coupling of the microwave energy to and from the waveguide filter. The strips 28 may be oriented such that they are parallel to the sides 16 and 18 of the bar 12 or oriented in any other manner capable of providing the input and output coupling of microwave energy to the waveguide filter 10.

Figure 6:
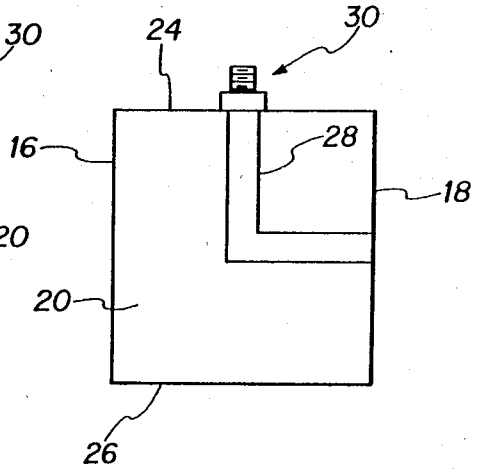
FIG. 6 is an end view of the waveguide filter shown in FIG. 1 showing a current coupling input.

In one example, the conductive strips 28 may be coupled as voltage probes (FIG. 3) in which case the conductors 28 are applied partially across the end faces 20 and 22 of the bar 12 without contacting the electrically conductive coating covering the remainder of the bar 12. Alternatively, the strip 28 may be generally formed as an L-shaped strip on the end faces 20 and 22 and coupled as a current probe (FIG. 6) wherein the end of the strip 28 opposite from that coupled to the center conductor of connector 30 is electrically coupled to the electrically conductive coating covering the surface of the bar 12 (e.g. on surface of side 16 or 18). Operation of the waveguide filter with the coupling strip 28 in FIG. 6 will produce current coupling while operation with the previously described coupling strip 28 of FIG. 3 will produce voltage coupling, both as is well known in the prior art. It should also be understood that although the strip conductors 28 have been shown for use with conventional coaxial connectors 30, other configurations of connectors 30 and conductors 28 may be used to couple the energy to and from the filter 10.

In the construction of the above device, the width w of the notches 14 is not critical to the operation of the circuit and is generally as small as may be produced with the technique used to form the notches 14 (e.g. machining, etc.). The depth d of the notches 14 as well as their spacing s is, however, selected to provide the appropriate filter characteristics for the microwave circuit in which the filter is to be used. More particularly, the depth d and spacing s may be varied so that the bandpass of the filter is changed as the depth is increased and decreased, respectively. Accordingly, in constructing the filter 10, the depth d and spacing s of the notches is first fixed at that value which will produce the desired bandpass characteristics prior to coating the surfaces 16, 18, 24 and 26 of the bar 12 with the electrically conductive coating.

In operation, coaxial cable may be coupled to the connectors 30 to couple microwave energy into the waveguide filter 10 which will pass through the waveguide and be extracted through a coaxial cable coupled to the connector 30 at the opposite end of the filter 10. When the ceramic material is selected to be of the type with the characteristics previously enumerated, the filter will be substantially insensitive to temperature changes and provide a fixed frequency bandpass regardless of the environment in which it is used. Accordingly, although tuning is not required, tuning screws or slugs similar to that used in many instances in the prior art, may be inserted into the bar 12 perpendicular to the surface 24 at positions substantially centrally located between the surface 16 and 18 and each of the three sections formed by the notches 14. The tuning screws 32 may be received in threaded holes in surface 24 or alternatively, holes in surface 24 may receive ceramic slugs which vary the tuning by varying the airgap between the bottom of the hole and the inserted slug.

Using the above structure, a simple, inexpensive and reliable waveguide filter 10 is formed which has a fixed frequency bandpass and which may be suitably used in a variety of environments. The size of the overall structure at a frequency of 1 GHz may be reduced by approximately a factor of 6 from that which would be required using a conventional air waveguide filter structure. By way of example, the overall dimensions of the rectangular structure shown in FIGS. 1 and 4 for operation at 1 GHz would be approximately 2–3 inches in length, 0.25 inch in height, and 0.5 inch in width. Use of the present filter eliminates the necessity for forming filters which include multiple dielectric resonators (as described in the above IEEE article) and the attendant complex configurations, arrangements, and operational problems.

Although the waveguide filter 10 has been described above in connection with the rectangular embodiment depicted in FIG. 1, it will be apparent that other configurations may be employed to produce similar results. Accordingly, a cylindrical bar 12 having circular notches 14 extending around the surface of the cylinder could be substituted for the rectangular bar 12. The same coupling, filtering, and relative reduction in dimensions could be achieved with such a cylindrical configuration.

Figure 5:
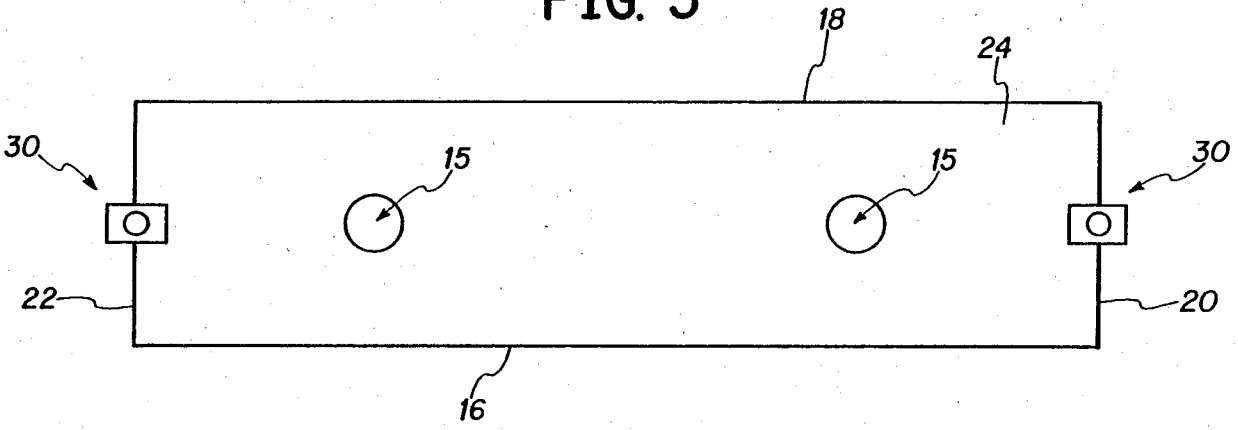
FIG. 5 is a top view of the waveguide filter of FIG. 4.
Figure 4:
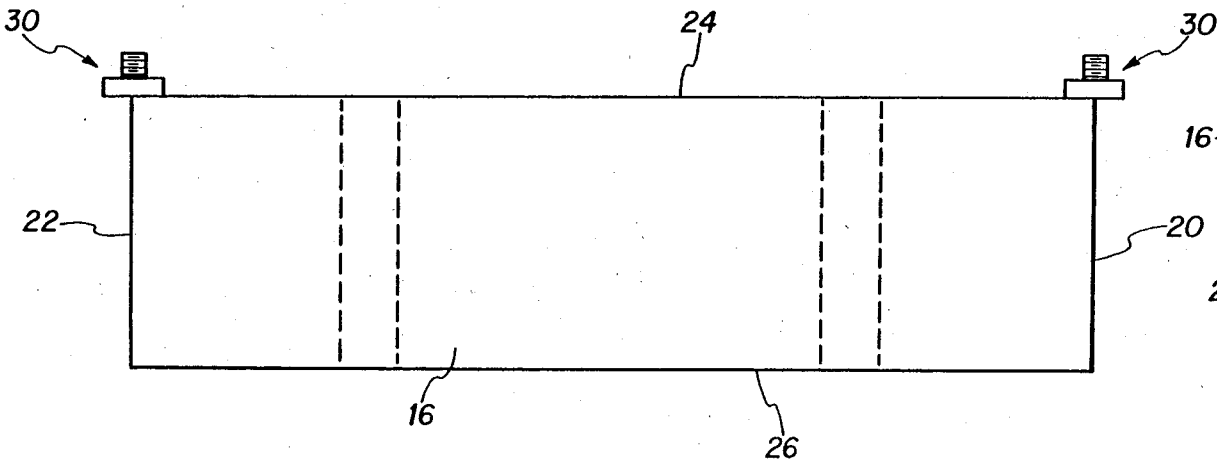
FIG. 4 is a side view of another embodiment of the waveguide filter of FIG. 1.

In still another variation of the present invention, the waveguide filter 10 could be constructed in accordance with the embodiment shown in FIGS. 4 and 5, wherein the notches (apertures) 14 are replaced with holes 15 extending through the bar 12 between the surfaces 24 and 26 and parallel to the end surfaces 20 and 22 and the side surfaces 16 and 18. The holes are located along the length of the bar 12 at substantially the same locations between the end surfaces 20 and 22 as the notches 14. In this embodiment, the holes 15 have their inner cylindrical surfaces coated when the electrically conductive coating is applied to the bar 12 to form the equivalent of prior art filtering posts. In this embodiment, the diameter of the hole 15 determines the particular filter characteristics and is accordingly fixed prior to the coating of the bar 12 with electrically conductive material. Again, in FIGS. 4 and 5, the filter is shown as a one-pole filter, but it will be apparent to one of ordinary skill in the art that the configuration of the bar 12 and holes 15 could be extended to construct a filter of any number of poles suitable for the particular environment required.

While the invention has been described with particular reference to the configuration of the embodiments shown in FIGS. 1 and 4, it is apparent that other configurations, shapes, modifications and variations could be employed. By way of example, the length of the bar 12 could be changed such that the coupling strips 28 are oriented on the ends 20 and 22 at an angle of 90° with respect to one another. Obviously, many other modifications and variations are possible in light of the above teachings. It is therefore to be understood that within the scope of the appended claims, the invention may be practiced otherwise than as specifically described.

What is claimed is:

1. An electrical filter comprising:

input means for receiving electrical energy having a frequency within a microwave range of 1–5 GHZ;

a filter body constructed and arranged to form a waveguide at said microwave frequencies and coupled to said input means for transmitting a selected band of frequencies within said received electrical energy frequency range, said filter body including a main body having a cylindrical configuration extending along a longitudinal axis and a plurality of circular U-shaped channels formed in said main body and spaced along said longitudinal axis to fix the frequency and bandwidth of said band, said filter body having an electrically conductive coating covering a portion of said main body and at least one of the said channels; and output means for providing an output of said transmitted electrical energy.

2. A method for filtering microwave energy comprising:

receiving microwave energy in the frequency range of about 1–5 GHz;

forming a filter body from a solid dielectric material to produce a waveguide at said frequency range of 1–5 GHz and having apertures formed therein and coated with a layer of electrically conductive material such that said apertures are constructed and arranged to transmit a predetermined band of microwave energy within said frequency range, said apertures being formed as a plurality of U-shaped channels having a depth and width and spacing selected to provide the predetermined band of microwave energy and said filter body being formed in a rectangular configuration having parallel end surfaces and pairs of opposed parallel side surfaces forming said rectangular configuration, said apertures being formed in the side surfaces of said body and said body being coated only on said side surfaces with said electrically conductive material;

coupling said received energy to said filter body through one of said end surfaces; and providing an output of said microwave energy within said predetermined band from the other of said end surfaces.

3. An electrical filter comprising:

input means for receiving electrical energy having a frequency within a microwave range of 1–5 GHz;

a filter body constructed and arranged to form a waveguide at said microwave frequency and coupled to said input means for transmitting a selected band of frequencies within said received electrical energy frequency range, said filter body including a main body and a plurality of U-shaped notches formed in said main body to fix the frequency and bandwidth of said band, said plurality of notches being positioned such that a first one of said plurality of notches is located a distance of one-quarter wavelength from said input means, a second one of said plurality of notches is located a distance of one-quarter wavelength from said output means, and the distance between adjacent apertures is equal to one-half wavelength, said filter body having an electrically conductive coating covering a portion of said main body and said plurality of notches; and output means for providing an output of the transmitted electrical energy.

4. An electrical filter comprising:

input means for receiving electrical energy having a frequency within a microwave range of 1–5 GHz;

a filter body constructed and arranged to form a waveguide at said microwave frequencies and coupled to said input means for transmitting a selected band of frequencies within said received electrical energy frequency range, said filter body including a main body having opposed first and second end surfaces coupled by at least one side surface and a plurality of U-shaped notches formed in said at least one side surface of said main body to fix the frequency and bandwidth of said band, said filter body having an electrically conductive coating covering only said at least one side surface of said main body and said plurality of notches, said input means being coupled to said first end surface for coupling said microwave energy into said filter body; and output means coupled to said second end surface for providing an output of said transmitted electrical energy from said filter body.

5. The apparatus of claim 4 further comprising means for varying the band of transmission.

* * * * *